US010908630B2

(12) United States Patent
Schmidt et al.

(10) Patent No.: US 10,908,630 B2
(45) Date of Patent: Feb. 2, 2021

(54) ASSEMBLY OF AN ELECTRIC DISPLAY AND A CONTROL DIAL HAVING FOREIGN-BODY INGRESS PROTECTION, VIEW PROTECTION, AND/OR LIGHT ISOLATION

(71) Applicant: PREH GMBH, Bad Neustadt a. d. Saale (DE)

(72) Inventors: Benedikt Schmidt, Bad Neustadt a. d. Saale (DE); Michael Schubert, Coburg (DE); Markus Klein, Salz (DE); Heiko Glienicke, Schweinfurt (DE)

(73) Assignee: PREH GMBH, Bad Neustadt a. d. Saale (DE)

( * ) Notice: Subject to any disclaimer, the term of this patent is extended or adjusted under 35 U.S.C. 154(b) by 195 days.

(21) Appl. No.: 15/760,045

(22) PCT Filed: May 19, 2016

(86) PCT No.: PCT/EP2016/061259
§ 371 (c)(1),
(2) Date: Mar. 14, 2018

(87) PCT Pub. No.: WO2017/045777
PCT Pub. Date: Mar. 23, 2017

(65) Prior Publication Data

US 2018/0253119 A1 Sep. 6, 2018

(30) Foreign Application Priority Data

Sep. 15, 2015 (DE) ..... 10 2015 115 514
Oct. 9, 2015 (DE) ..... 10 2015 117 226

(51) Int. Cl.
*G05G 1/10* (2006.01)
*G05G 25/04* (2006.01)

(52) U.S. Cl.
CPC ..... *G05G 1/105* (2013.01); *G05G 25/04* (2013.01)

(58) Field of Classification Search
CPC ..... G05G 1/105; G05G 25/04; B60K 37/06; B60K 2370/145; B60K 2370/143;
(Continued)

(56) References Cited

U.S. PATENT DOCUMENTS 4,158,216 A * 6/1979 Bigelow ..... H03K 17/98 200/600
5,841,428 A 11/1998 Jaeger et al.
(Continued)

FOREIGN PATENT DOCUMENTS

DE 102010010574 A1 * 9/2011 ..... B60K 37/06
DE 102010010574 A1 9/2011
(Continued)

OTHER PUBLICATIONS

First Office Action dated Jan. 4, 2016 for German Patent Application No. 10 2015 117 226.7 from the European Patent Office, Munich, Germany.
(Continued)

*Primary Examiner* — Thomas C Diaz
(74) *Attorney, Agent, or Firm* — M&B IP Analysts, LLC

(57) ABSTRACT

The present disclosure relates to a display adjuster including a rotary adjuster; and an electronic display including a transparent outer layer, wherein the rotary adjuster includes an actuation member and a rotational detection means, wherein the actuation member is rotatably mounted about a rotational axis mounted with bearing means, and the rotary adjuster is arranged on the transparent layer; and the display adjuster also includes a surrounding wall on the transparent layer that surrounds at least the bearing means.

18 Claims, 4 Drawing Sheets

(58) Field of Classification Search
CPC ..... B60K 2370/126; H03K 17/975; H03K 2217/9653; H03K 2217/96054; H03K 2217/94073; G06F 3/016
See application file for complete search history.

(56) References Cited

U.S. PATENT DOCUMENTS

| | | | | |
|---|---|---|---|---|
| 8,436,833 | B2 * | 5/2013 | King | G06F 3/0421 345/175 |
| 8,576,202 | B2 * | 11/2013 | Tanaka | G06F 3/0416 345/177 |
| 9,535,447 | B2 * | 1/2017 | Vogt | H01H 9/165 |
| 2006/0096845 | A1 * | 5/2006 | Zegula | G05G 5/03 200/341 |
| 2006/0256090 | A1 * | 11/2006 | Huppi | A63F 13/02 345/173 |
| 2008/0238879 | A1 * | 10/2008 | Jaeger | G06F 3/03545 345/173 |
| 2012/0069517 | A1 | 3/2012 | Prest et al. | |
| 2014/0042004 | A1 | 2/2014 | Tseng | |
| 2014/0220147 | A1 | 8/2014 | Arvis et al. | |
| 2015/0220147 | A1 | 8/2015 | King et al. | |

FOREIGN PATENT DOCUMENTS

| | | | |
|---|---|---|---|
| EP | 2511807 | A2 | 10/2012 |
| EP | 2821709 | A1 | 1/2015 |
| FR | 3033422 | A1 | 9/2016 |
| FR | 3033423 | A1 | 9/2016 |
| GB | 2485227 | A | 5/2012 |
| WO | 9908260 | A1 | 2/1999 |
| WO | 2016041683 | A1 | 3/2016 |

OTHER PUBLICATIONS

The International Search Report and the Written Opinion for PCT/EP2016/061259, dated Nov. 18, 2016, EPO, Rijswijk, The Netherlands.

* cited by examiner

ASSEMBLY OF AN ELECTRIC DISPLAY AND A CONTROL DIAL HAVING FOREIGN-BODY INGRESS PROTECTION, VIEW PROTECTION, AND/OR LIGHT ISOLATION

This application claims priority under 35 U.S.C. § 371 to the International Application No. PCT/EP2016/061259, filed May 19, 2016, and to the German Application No. 10 2015 115 514.1, filed Sep. 15, 2015, now pending, and to the German Application No. 10 2015 117 226.7, filed Oct. 9, 2015, now pending, the contents of which are hereby incorporated by reference.

The present disclosure relates to an arrangement comprising a rotary adjuster with rotary position detection and an electronic display having an outer transparent layer. The rotary adjuster is rotatably mounted on the transparent layer with a bearing means. Such a combination arrangement is becoming increasingly popular since on the one hand, due to versatile display capabilities of the electrical display, the rotary adjuster can be provided with various functions and function indicators, and on the other hand, the rotary adjuster with its actuation member provides a customary haptic feedback and can easily be touched by the driver without visual contact. Thanks to the arrangement of the rotary adjuster on the usually horizontal or (relative to the gravity field) oblique transparent layer of the electrical display, there is on the one hand the problem that accidentally spilled liquids, but also deliberately applied and often aggressive cleaning agents or other foreign bodies can easily enter the rotary adjuster. This jeopardizes the function of the rotary adjuster and can damage its mounting and its rotary position detection. On the other hand, there is the problem of undesired light emission and an undesired observation of or from the section of the electronic display arranged below the rotary adjuster, for example when due to the rotational mounting it is not covered to make it light-proof, or if it cannot be controlled without any loss of light.

In view of this background, a solution was called for which reduces the risk of foreign-body intrusion, especially the intrusion of liquids, and/or the risk of undesired light emission. This object is achieved by means of an arrangement according to Claim 1. An equally advantageous application is the object of the application claim. Advantageous embodiments are the object of the sub-claims. It should be noted that the characteristics mentioned in the individual claims can be combined with each other in any technologically reasonable manner to indicate further embodiments of the present disclosure. The description, particularly in conjunction with the drawings, additionally characterizes and specifies the present disclosure.

The present disclosure relates to an arrangement comprising a rotary adjuster and an electronic display. The rotary adjuster comprises an actuation member rotatably mounted via bearing means of preferably annular shape, and means to detect the rotary position, i.e. means suited for detecting the position and/or the change in position of the actuating member. Preferably, the bearing means comprise a roller bearing such as a ball bearing. Preferably, this is a non-contact detection means such as an optically detecting means. The arrangement also comprises an electronic display with a transparent outer layer. This can be a backlit liquid-crystal display, for example of TFT configuration, or a display of OLED design.

The outer transparent layer can be a plastic layer, preferably a surface-hardened plastic layer, for example to protect the underlying electrode structure of a capacitive sensor system or the polarization layer of the electrical display against damage. Even more preferably, the transparent layer can be a glass layer.

In one embodiment, the display is a touch-sensitive display, preferably a touch-sensitive display with capacitive touch detection.

According to the present disclosure, the rotary adjuster is arranged on the transparent layer. According to the present disclosure, the arrangement also comprises a surrounding wall on the transparent layer. It surrounds at least the bearing means. Preferably, the wall is defined by a wall-like protrusion. Preferably, the wall-like protrusion is of annular shape.

The term "annular" does not necessarily mean that the ring is circular although such a circular form is preferable.

The surrounding wall or wall-like protrusion protects the bearing means of the rotary adjuster, which means is behind the wall as seen radially toward the inside, against the intrusion of foreign bodies, especially of liquids, and also prevents at least any damage to the bearing means; furthermore the wall protects against light emission from the inside of the rotary adjuster, especially light emission from the region of the display that is covered by the rotary adjuster, in the direction of the outside of the rotary adjuster facing the operator.

The term "wall-like" should not be narrowly interpreted; it includes an embodiment where the radially outside wall of the protrusion is diagonal to the plane defined by the transparent layer; preferably, the radially outside wall of the protrusion is vertical to the plane defined by the transparent layer. The term "wall-like" does not necessarily mean a wall that is radially on the inside. Preferably a radially inside wall is provided as it results, for example, from an annular embodiment of the protrusion. According to an even more preferred embodiment, the radially inside wall runs parallel to the radially outside wall. Below, the term "wall" is meant to have at least one radially outside wall.

For example, "protrusion" means a height of the protrusion related to the adjacent surface of the transparent layer, which is selected from a range of 1.0 mm to 8.0 mm, but even more preferably from a range of 0.8 mm to 5.0 mm, such as 2.5 mm. In one embodiment, the protrusion in not in touch contact with the rotary adjuster and in particular not with its actuation member.

It is preferably provided that the surrounding wall and the actuation member are formed of opaque material and that the wall or the protrusion and the actuation member are adjacent to each other with a circumferential air gap between the wall and the actuation member to more effectively avoid any undesired light emission.

It is preferably provided that the air gap extends from an inside of the rotary adjuster to an outside of the rotary adjuster and that the air gap that extends from inside to outside comprises a sloping section defined by the rotational axis in radial direction of the transparent layer. This means that with a customary operating distance and viewing distance, any undesired observation of the interior of the rotary adjuster is prevented and also—where applicable—a view of the section covered up by the rotary adjuster and the unused portion of the display due to the arrangement of the rotary adjuster.

It is preferably provided that the air gap is limited by a first surrounding surface of the wall, for example the free face of the wall, and by a second surrounding surface of the actuation member, for example by a surface facing away from the operating surface of the actuation member and facing the wall, wherein the first and second surfaces are parallel to each other. For example, the first and second surfaces are each formed by a cone-shaped surface.

It is preferably provided that the course of the air gap in radial direction has one or more curvatures and/or creases. For example, its course in radial direction can change regularly or irregularly.

For example, it is provided that the face of the wall or protrusion together with a correspondingly formed circumferential groove and/or circumferential edge in or on the actuation member forms a labyrinth seal.

According to another embodiment, the rotary adjuster is provided with at least one aperture surrounded by the wall or wall-like protrusion to allow a view and/or optical projection through the aperture by means of the electrical display. For example, only one aperture is provided for the operator to see through to the display section below it and to observe the function symbol displayed there. For example, an arrangement surrounded by the wall means a central arrangement on the imagined rotational axis of the rotary adjuster, but also a non-central arrangement in the volume defined by the radial outer wall of the protrusion. Thus, the portion of the display arranged there and the optical elements that may also be arranged there are also protected against the intrusion of liquid from the transparent layer. The undesired wetting with a liquid due to a capillary effect can considerably impair the optical effectiveness of the display.

According to a preferable embodiment of the arrangement, the aperture is provided with a light conductor or with a projection layer arranged in the aperture or with optics such as projection optics arranged in the aperture. For example, such optics can also mean a lens array of lenses arranged in a parallel plane to form a display. According to the present disclosure, a combination of the above named elements can be provided as well.

For example, the light conductor, the projection layer and/or the optics can be positively connected with the transparent layer, for example by means of a bayonet connection. In accordance with one preferable embodiment, the light conductor, the projection layer and/or the optics is interlockingly or positively connected with the transparent layer. For example, an adhesive connection and/or a detent connection can be provided. Alternatively, the above named elements can be formed in one piece with the transparent layer.

For example, a one-piece version can be achieved in a moulding process in a joint spraying step or in a multi-stage spraying process.

Furthermore, to protect the detection means against the intrusion of foreign bodies, a preferred embodiment of the present disclosure provides that the wall or the wall-like protrusion surrounds parts of the means of rotary position detection such as the rotary position sensor. For example, these are capacitive detection means. These detection means react sensitively to the intrusion of foreign bodies.

According to a preferable embodiment, the transparent layer is a glass layer, preferably a glass layer with a thermal linear extension coefficient at 20° C. between 3.2 and $8.7\times10^{-6}$/K, even more preferably made of borosilicate glass, aluminum silicate glass or soda-lime float glass. Such glass layers can be easily processed and shaped by heating the glass layer above the transformation temperature, for example to develop the protrusion. Such a glass plate has high stability and is particularly advantageous to the touch. For example, the thickness of the plate is between 0.5 mm and 2.0 mm, such as 1.1 mm.

According to another embodiment, the bearing means comprise means to produce a haptic feedback when the rotary adjuster 2 is turned, wherein these means are arranged to produce a haptic feedback such as a grid contour. Thus a detent spring 25 is provided by which the wall or the wall-like protrusion 5 is surrounded.

Preferably, the bearing means comprises a friction bearing or roller bearing whose inner track, for example the inner track of the roller bearing, or the inner friction track in the direction of the operator, usually in the direction of the operator, as a rule upwardly, is offset to the transparent layer, on a base, preferably on an annular base, or the base can define an inner track of the friction bearing or roller bearing arranged such that in the direction of the operator, as a rule upwardly, it is offset to the transparent layer. The base also has the purpose of providing an additional barrier—in addition to the wall—against the intrusion of contamination and liquid.

For example, the base is positively connected with the transparent layer. According to a preferred embodiment, the base is interlockingly or positively connected with the transparent layer or formed in one piece with the transparent layer. For example, the base can be connected with the transparent layer by means of an adhesive connection or a detent connection.

Preferably, the base is interlockingly or positively connected with the light conductor and/or the projection layer and/or the optics, or formed in one piece with the light conductor and/or the projection layer and/or the optics.

Preferably, the base is formed in one piece with the surrounding wall, particularly when there is an adhesive connection between the transparent layer and the surrounding wall or the base. For example, the transitional section between the base and the wall, forming the one piece, is defined by an annular wall or by several radially extending braces, which are designed to fit against the transparent layer. For example, the material thickness of this wall or of the braces in a direction vertical to the transparent layer is less than 1 mm. For example, the apertures are provided in the wall so as not to impair the capacitive position detection.

The present disclosure also relates to the application of one of the embodiments of the above described arrangement in a motor vehicle. For example, the arrangement is provided in a central panel of the motor vehicle.

The present disclosure also relates to a process for manufacturing a glass layer with at least one wall-like protrusion defining a surrounding wall wherein the process consists of the following steps:

Providing a glass layer of a certain thickness; providing a tool die with a surface that has at least one depression with a depth that is greater than the thickness of the glass layer; laying the glass layer onto the tool die, heating the glass layer to a temperature above the transition temperature; reshaping the glass layer until it takes the contour of the tool die which represents the positive surface of the tool die wherein the glass layer forms at least one protrusion to match a corresponding depression of the tool die to form at least the wall-like annular projection; cooling the glass layer to a temperature below the transition temperature; and removing the glass layer from the tool die. For example, the thickness of the glass layer is 0.5 mm to 2 mm, such as 1.1 mm. For example, the glass layer can be made of borosilicate glass, aluminum silicate glass or soda-lime float glass.

According to a preferable version of the process, a base for fastening a roller bearing is defined by a further preferably annular protrusion in the glass layer.

Below, the present disclosure is described in detail with reference to the drawings. The drawings are only to be understood as examples, each representing only one preferable embodiment, where FIG. 1 shows a sectional view of a first embodiment of the present disclosure;

Figure 1:
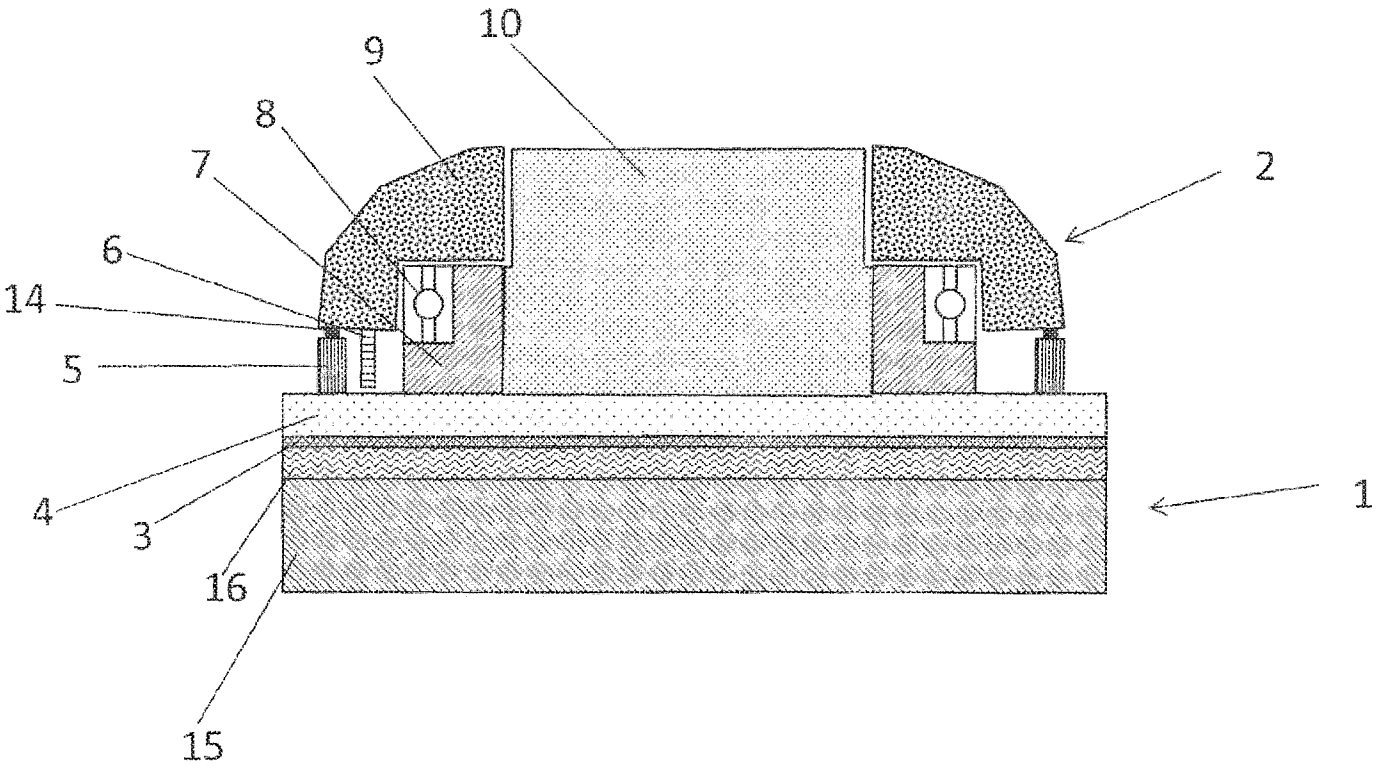

FIG. 1 shows a first embodiment of the present disclosure. According to the present disclosure, the arrangement comprises an electronic display 1 and a rotary adjuster 2, arranged on electronic display 1. Display 1 has a lower layer or layer composition 15, which essentially serves to visualize the electronic data such as those showing the functionality of the function symbols assigned to the rotary adjuster. In the present case, it is a conventional layer composition in TFT technology. Above it, a transparent adhesive layer 16 and a transparent electrode array 3 for providing a capacitive sensor system are provided. Above it, a transparent glass layer 4 is provided which defines an outer surface, in this case an upper surface, on which rotary adjuster 2 is arranged. Rotary adjuster 2 comprises an annular actuation member 9 of opaque material, which is rotatable fastened to transparent layer 4. The rotational mounting is achieved with roller bearing 8 supported by an annular base 7 wherein the inside track of roller bearing 8 is arranged such that in the direction of the operator, in this case upwardly, it is offset to transparent layer 4. Base 7 is glued to transparent layer 4. For detecting the rotary position of actuation member 9, a capacitive position sensor 6 is also provided, which is arranged on a flange facing transparent layer 4 of actuation member 9. Its position is detected by the above described electrode structure 3 on the display side. In the central aperture of rotary adjuster 2 defined by the annular actuation member 9 and the annular base 7, a light conductor 10 is arranged, which allows the operator to view display 1 below it, particularly the function symbol it represents.

For the protection of mounting 8, of the capacitive sensor system, in particular of capacitive position sensor 6, and of light conductor 10 in the center of rotary adjuster 2, against the intrusion of foreign bodies, especially of liquids, a circumferential annular protrusion is provided on annular layer 4. This protrusion of an opaque plastic material such as a thermoplastic, is glued to transparent layer 4 and has a surrounding sealing lip 14 at its opposite free end, which is in grinding contact with actuation member 9 to achieve a particularly effective liquid-sealing, light-shielding and opaque effect.

Figure 2:
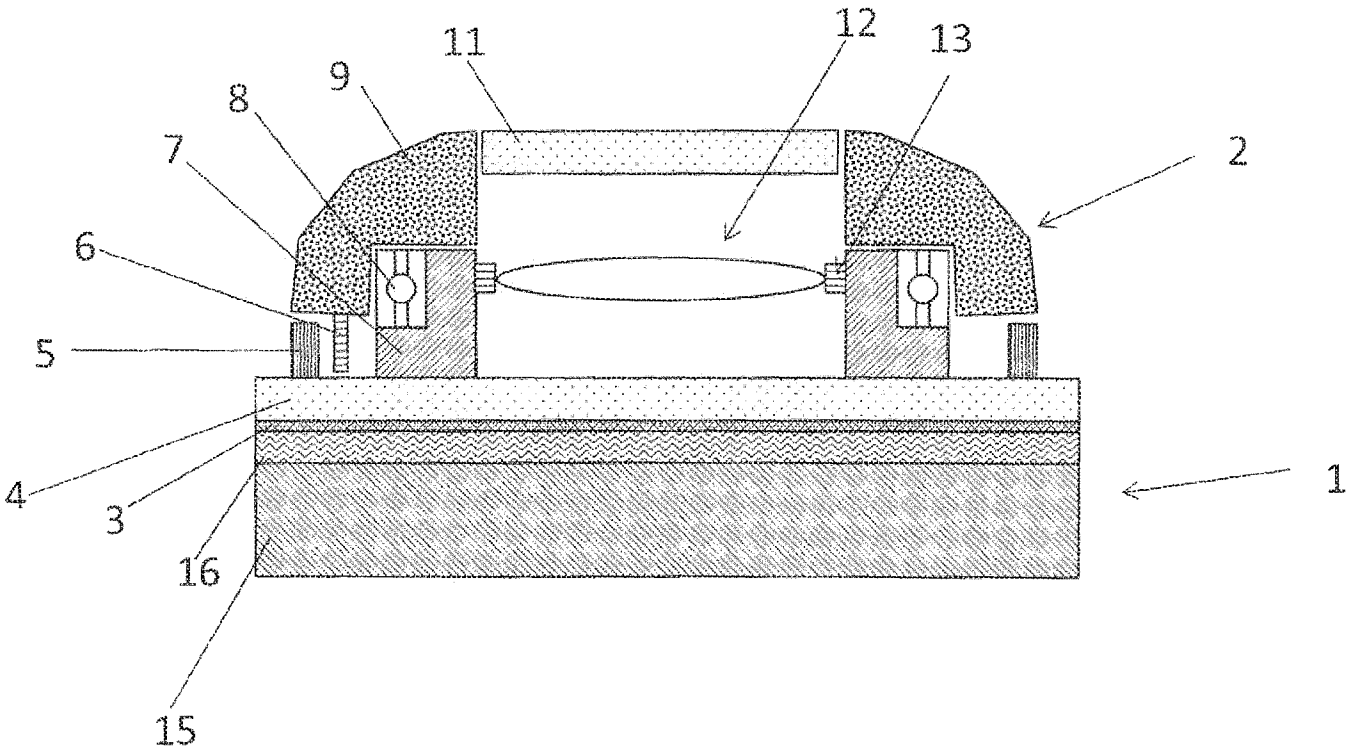
FIG. 2 shows a sectional view of a second embodiment of the present disclosure.

FIG. 2 shows a second embodiment of the present disclosure. According to the present disclosure, the arrangement comprises an electronic display 1 and a rotary adjuster 2 arranged on electronic display 1. Display 1 has a lower layer or layer composition 15 that serves mainly to visualize electronic data such as a function signal assigned to the functionality of the rotary adjuster. In the present case, it is a conventional layer composition in TFT technology. Provided above this are a transparent adhesive layer 16 and a transparent electrode array 3 for the capacitive sensor system. Above this, a transparent glass layer 4 is provided which defines an outer surface, in this case an upper surface, on which rotary adjuster 2 is arranged. Rotary adjuster 2 has an annular actuation member 9, which is rotatably fastened to transparent layer 4. The rotational mounting is provided via a roller bearing 8 supported by an annular base 8 wherein the inner track of roller bearing 8 is arranged such that in the direction of the operator, in this case upwardly, it is offset to transparent layer 4. Base 7 is glued to transparent layer 4. For detecting the rotary position of actuation member 9, a capacitive position sensor 6 is also provided that is arranged on a flange of actuation member 9 that faces transparent layer 4. Its position is detected by the above described capacitive electrode structure 3 on the display side. In the central aperture of rotary adjuster 2, defined by annular actuation member 9 and annular base 7, a projection layer 10 designed as a diffusely translucent matt screen on which an image is projected that is produced with a lens optics 12 on the display below. Lens optics 12 is fastened to base 7 with fastening means 13. Alternatively, the individual lens 12 can be replaced by an array of micro lenses.

To protect mounting 8, the capacitive sensor system and in particular the capacitive position sensor 6, as well as optics 12 provided in the center of rotary adjuster 2, against the intrusion of foreign bodies, in particular liquids, a surrounding annular protrusion 5 is provided on transparent layer 4. This protrusion is made of a plastic material such as thermoplastic, is glued to transparent layer 4, and with the surface opposite its free end it has no contact with actuation member 9 but forms an air gap with the same.

Figure 3:
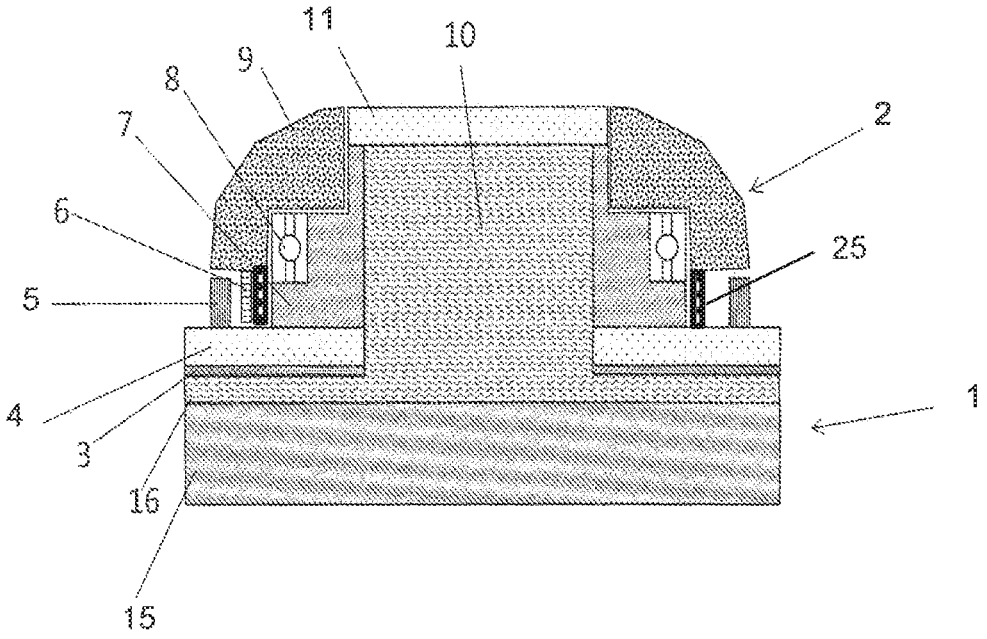
FIG. 3 shows a sectional view of a third embodiment of the present disclosure.

FIG. 3 shows a third embodiment of the present disclosure. According to the present disclosure, the arrangement comprises an electronic display 1 and a rotary adjuster 2, arranged on electronic display 1. Display 1 has a lower layer or layer composition 15, which essentially serves to make electronic data visible, such as a function symbol assigned to the functionality of the rotary adjuster. In the present case, this is a conventional layer composition in TFT technology. Above this is an adhesive layer 16 and a transparent electrode array 3 for providing a capacitive sensor system. Above this is a transparent glass layer 4 defining an outer surface, in this case an upper surface, on which rotary adjuster 2 is arranged. Rotary adjuster 2 has an annular actuation member 9 that is rotatably fastened to transparent layer 4. The rotational mounting is achieved via a roller bearing 8 supported by a base 7 wherein the inner track of roller bearing 8 in the direction of the operator, here upwardly, is offset to transparent layer 4. Base 7 is glued to transparent layer 4. For detecting the rotary position of actuation member 9, a capacitive position sensor 6 is also provided that is arranged on a flange of actuation member 9 facing transparent layer 4. Its position is detected by the above described capacitive electrode structure 3 on the display side.

An image produced by display 1 is projected in the central aperture of rotary adjuster 2, which central aperture is defined by annular actuation member 9, by a aperture formed in transparent layer 4 and by annular base 7. For that purpose, a projection layer 11 is arranged in the aperture onto which the image is projected by display 1 that lies under light conductor 10, which extends through the aperture. In the present case, light conductor 10 is formed by adhesive layer 16, which serves to glue at least two layers on the display side.

A surrounding annular protrusion is provided on transparent layer 4 for protecting mounting 8, the capacitive sensor system, in particular the capacitive position sensor 6 and light conductor 10 in the center of rotary adjuster 2 against the intrusion of foreign bodies, particularly liquids. This protrusion 5 is made of an opaque plastic material such as thermoplastic, is glued to transparent layer 4, and with the surface opposite its free end it has no contact with actuation member 9 but forms an air gap with the same.

Figure 4:
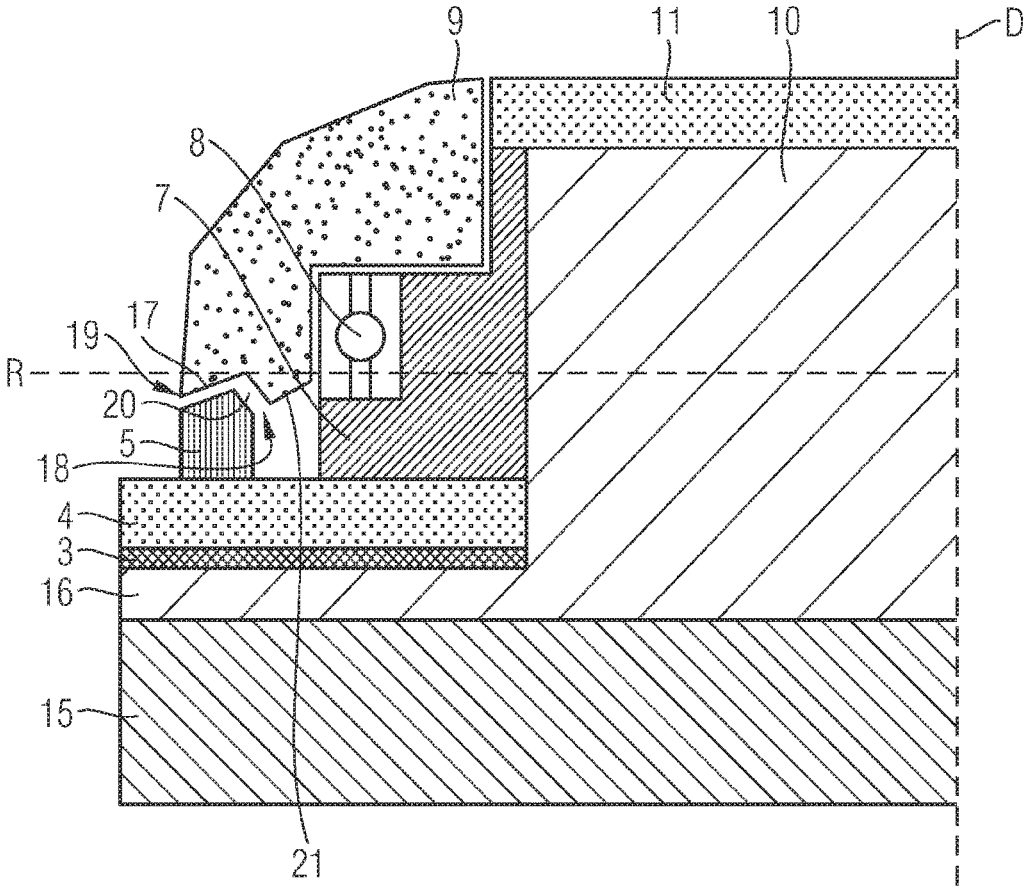
FIG. 4 shows a partial sectional view of a fourth embodiment of the present disclosure.

The fourth embodiment shown in FIG. 4 substantially differs from the third embodiment by the shape or course of air gap 20 formed between actuation member 9 and the wall, or more accurately between the first surrounding surface of the wall facing actuation member 9 and the inward facing second surface of actuation member 9. The first and second surface extend parallel to each other. The air gap extends circumferentially between the wall and actuation member 9. Its course through protrusion 21 on the operating side shows a crease wherein the outer portion 20 of the gap—relative to a radial direction R which is vertical to rotational axis D—is sloping in the direction of transparent layer 4 such that it has a particularly good light-shielding and opaque effect while avoiding any grinding contact between actuation member 9 and wall 5.

The invention claimed is:

1. A display adjuster, comprising:

a rotary adjuster;

an electronic display having a transparent outer layer; and a surrounding wall on the transparent outer layer that surrounds at least a bearing means, wherein the surrounding wall includes an annular projection located above the transparent outer layer, wherein:

the rotary adjuster comprises an actuation member and a rotational position detection means;

the actuation member is rotatably mounted about a rotational axis by a bearing means;

the rotary adjuster is arranged on the transparent outer layer;

at least one aperture located at the center of the rotary adjuster is provided for visibility or optical projection of the electronic display through the transparent outer layer;

the bearing means comprises a roller bearing that is arranged on an annular base and having an inner track, the roller bearing supported by the annular base so that the roller bearing is offset from the transparent outer layer in a direction to an operator;

the annular base includes an outer circumference and an inner circumference, the inner circumference defining an inside track of the roller bearing that is in contact with the inner circumference of the annular base; and a bottom portion of the annular base having the outer circumference supports the roller bearing.

2. The display adjuster of claim 1, wherein the surrounding wall and the actuation member are made of an opaque material, and that the surrounding wall and the actuation member are arranged adjacent to each other with a circumferential air gap between the surrounding wall and the actuation member.

3. The display adjuster of claim 1, wherein an air gap extends from an interior of the rotary adjuster to an exterior of the rotary adjuster, and that a course of the air gap that extends from inside to outside comprises a sloping section defined by the rotational axis in radial direction of the transparent layer.

4. The display adjuster of claim 2, wherein the circumferential air gap is limited by a first surrounding surface of the surrounding wall and a second surrounding surface of the actuation member which faces the surrounding wall, wherein the first and the second surfaces run parallel to each other.

5. The display adjuster of claim 2, wherein the course of the circumferential air gap in radial direction has one or more curvatures or creases.

6. The display adjuster of claim 1, wherein the aperture includes at least one of: a light conductor, a projection layer, or an optics.

7. The display adjuster of claim 6, wherein the light conductor, the projection layer, or the optics are interlockingly or positively connected with the transparent layer or are formed in one piece with the transparent layer.

8. The display adjuster of claim 6, wherein the annular base is interlockingly or positively connected with the at least one of: the light conductor, the projection layer, or the optics, or the annular base is formed in one piece with the at least one of:

the light conductor, the projection layer, or the optics.

9. The display adjuster of claim 6, wherein the optics comprises a projection optics, when the aperture includes the optics.

10. The display adjuster of claim 1, wherein the surrounding wall at least partially surrounds the rotational position detection means.

11. The display adjuster of claim 1, wherein the annular projection and the transparent layer are formed in one piece.

12. The display adjuster of claim 1, wherein the annular projection and the transparent layer are interlockingly connected.

13. The display adjuster of claim 1, wherein the transparent layer is a glass layer with a thermal linear extension coefficient at 20° C. between 3.2 and $8.7\times10^{-6}$/K.

14. The display adjuster of claim 1, wherein the rotational position detection means is designed to detect the rotary position or the change in rotary position of the rotary adjuster with a capacitive detection means.

15. The display adjuster of claim 1, wherein the bearing means further includes a detent spring that is configured to generate a haptic feedback when the rotary adjuster comprising the roller bearing is turned, the detent spring being surrounded by the wall.

16. The display adjuster of claim 1, wherein the annular base is formed in one piece with the surrounding wall.

17. The display adjuster of claim 1, wherein the annular base is interlockingly or positively connected with the transparent layer or formed in one piece with the transparent layer.

18. The display adjuster of claim 1, wherein the display adjuster is installed within a motor vehicle.

* * * * *